US005612707A

United States Patent [19]

Vaughan et al.

[11] Patent Number: 5,612,707

[45] Date of Patent: Mar. 18, 1997

[54] STEERABLE BEAM HELIX ANTENNA

[75] Inventors: Rodney G. Vaughan, Lower Hutt; Neil L. Scott; Colin A. Jenness, both of Stokes Valley, all of New Zealand

[73] Assignee: Industrial Research Limited, Lower Hutt, New Zealand

[21] Appl. No.: 325,324

[22] PCT Filed: Apr. 23, 1993

[86] PCT No.: PCT/NZ93/00027

§ 371 Date: Dec. 23, 1994

§ 102(e) Date: Dec. 23, 1994

[87] PCT Pub. No.: WO93/22804

PCT Pub. Date: Nov. 11, 1993

[30] Foreign Application Priority Data

Apr. 24, 1992 [NZ] New Zealand ..... 242498

[51] Int. Cl.[6] ..... H01Q 1/36

[52] U.S. Cl. ..... 343/895

[58] Field of Search ..... 343/895, 893, 343/795, 700 MS; H01Q 1/36, 11/08

[56] References Cited

U.S. PATENT DOCUMENTS

| | | | |
|---|---|---|---|
| 3,510,872 | 5/1970 | Mullaney . | |
| 3,524,193 | 8/1970 | Auletta . | |
| 3,699,585 | 10/1972 | Morrison . | |
| 3,824,600 | 7/1974 | Majkrzak et al. . | |
| 3,836,979 | 9/1974 | Kurland et al. . | |
| 3,999,106 | 12/1976 | Kratomi . | |
| 4,068,238 | 1/1978 | Acker . | |
| 4,087,820 | 5/1978 | Henderson . | |
| 4,204,212 | 5/1980 | Sindoris et al. | 343/700 MS |
| 4,323,900 | 4/1982 | Krall et al. | 343/700 MS |
| 4,381,566 | 4/1983 | Kane | 343/806 X |
| 4,427,984 | 1/1984 | Anderson . | |
| 4,475,111 | 10/1984 | Gittinger et al. . | |
| 4,740,795 | 4/1988 | Seavey . | |
| 5,099,249 | 3/1992 | Seavey . | |
| 5,134,422 | 7/1992 | Auriol | 343/895 |
| 5,146,235 | 9/1992 | Frese . | |
| 5,198,831 | 3/1993 | Burrelli et al. | 343/895 |
| 5,255,005 | 10/1993 | Terret et al. | 343/895 |
| 5,266,962 | 11/1993 | Möbius et al. . | |
| 5,346,300 | 9/1994 | Yamamoto et al. | 343/895 |

FOREIGN PATENT DOCUMENTS

| | | |
|---|---|---|
| 63-026004 | 2/1988 | Japan . |
| 92/05602 | 4/1992 | WIPO . |

OTHER PUBLICATIONS

"Antennas, " John De Kraus, 2nd Edition, McGraw Hill Book Company, 1950, p. 273.

*Primary Examiner*—Donald T. Hajec
*Assistant Examiner*—Tho Phan
*Attorney, Agent, or Firm*—Lowe, Price, LeBlanc & Becker

[57] ABSTRACT

A variable helix antenna consisting of one or more conductors affixed to a furled dielectric sheet. The antenna beam being steerable by furling and unfurling of the dielectric sheet either rotationally, axially or by a combination of both. Multiple interleaved dielectric sheets may be used for multifilar embodiments and matching and compensation elements may also be provided on the dielectric sheet.

10 Claims, 15 Drawing Sheets

STEERABLE BEAM HELIX ANTENNA

TECHNICAL FIELD

This invention relates to a helical antenna which may be manipulated to change characteristics of the antenna. More particularly, but not exclusively, the invention relates to a "scanning mode" helix antenna in which the antenna may be manipulated to steer the beam of the antenna. The antenna of the invention is particularly suitable for use in communications applications in the 800 to 5,000 MHz range.

BACKGROUND TO THE INVENTION

Steerable beam helix antenna are used for mobile communications, including land, sea and air-borne terminals, satellite communications and/or in situations where inference sources are suppressed by manipulation of the shape of the antenna to vary its radiation pattern.

The helix antenna is well-known, as are its many modes of operation; see for example the book "antennas" by John De Kraus 2nd edition, McGraw Hill Book Company, 1950 (herein referred to as "Kraus") at page 273. The particular mode of operation depends upon parameters of the antenna, such as the number of helical conductors, the pitch angle of the conductors, antenna length and, to a lesser extent, the conductor size. One mode of operation is the so called "scanning mode" of operation. In this mode the helix is of electrically small diameter (about 0.1 wavelengths), of large pitch angle (about 60 degrees) and has several turns. This mode is referred to as the "scanning mode" as for a fixed antenna construction the beam of the antenna can scan by varying the frequency of operation. This technique may be used in radar and direction finding equipment.

Alternatively, when operating at a nominally constant frequency, the radiation pattern of the antenna can be scanned by altering parameters of the antenna.

U.S. Pat. Nos. 3,524,193; 3,510,872; 4,475,111; 3,699,585; 3,836,979 and 4,068,238 disclose helical antennas of adjustable length. However, these antennas are foldable, collapsible or telescoping only for the purpose of enabling transportation in a more compact state.

U.S. Pat. No. 4,087,820 discloses a short wave antenna which allows the height of the antenna to be varied whilst the antenna pitch remains constant. This allows the antenna to be turned to resonance within a wide frequency range. The antenna is however extremely high and the construction would be unsuitable for antenna having a large pitch angle, especially when used in mobile applications.

U.S. Pat. No. 5,146,235 discloses a UHF antenna in which the number of turns or the height of the antenna may be adjusted. The conductor is a helical spring and its height and number of turns may be adjusted by mechanical means. Such a structure would be unsuitable for an antenna having a large pitch angle. The spring would tend to resonate, which would produce distortion, especially in multifilar antennas. The problem would be particularly apparent when the antenna was mounted to a moveable vehicle.

DISCLOSURE OF THE INVENTION

It is an object of the invention to provide a scanning mode antenna suitable for use in mobile communications applications wherein parameters of the antenna may be manipulated to vary the radiation pattern of the antenna, or to at least provide the public with a useful choice.

According to the invention there is provided a helix antenna comprising a conductor secured to a dielectric sheet, the dielectric sheet being furled so that the conductor is of generally helical form, said dielectric sheet being furlable and unfurlable to alter the characteristics of the antenna.

The antenna may be rotationally or axially furled and unfurled or a combination of both methods may be used. A plurality of conductors may be provided on the dielectric sheet for multifilar applications. Multiple dielectric sheets having one or more conductor thereon may be interleaved to optimise the relative positions of the conductors. The conductors are preferably positioned so that they are evenly spaced in the axial direction of the antenna and closely radially spaced (i.e. lying substantially along the outer surface of a cylinder).

In a preferred embodiment one end of a dielectric sheet is secured to a central tube and the other side is secured to a radome surrounding the antenna. The dielectric sheet may be furled and unfurled by rotating the radome. The radome may be rotated by drive means controlled by control means in response to information received from a received signal strength indicator.

Baluns or matching elements may be provided on the dielectric sheet. Load elements may also be provided partway along the conductors for frequency scanning compensation.

BRIEF DESCRIPTION OF THE DRAWINGS

FIG. 9*d* shows the co-polar and cross-polar (dotted line) patterns for a separate prototype;

BEST MODE FOR CARRYING OUT THE INVENTION

Figure 1A:
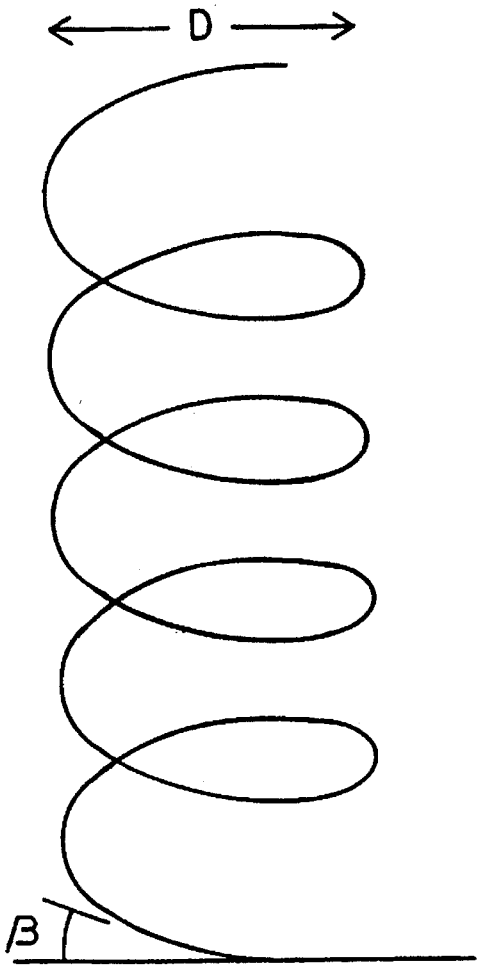
FIG. 1*a*: shows a monofilar (single conductor) helix.
Figure 1B:
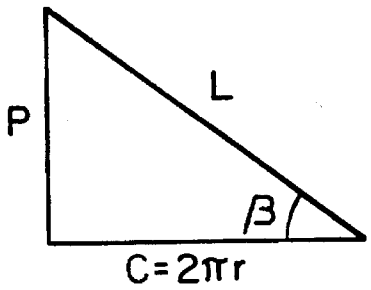
FIG. 1*b*: shows one unwrapped turn of the helix of FIG. 1*a* and illustrates the antenna parameters.

FIG. 1*a* shows a helical conductor of a helix antenna and FIG. 1*b* shows the measured parameters for one turn of the conductor. B is the pitch angle, D is the antenna diameter, r is the antenna radius, p is the antenna pitch and L is the turn length. The circumference C is given by C=2IIr.

Figure 2A:
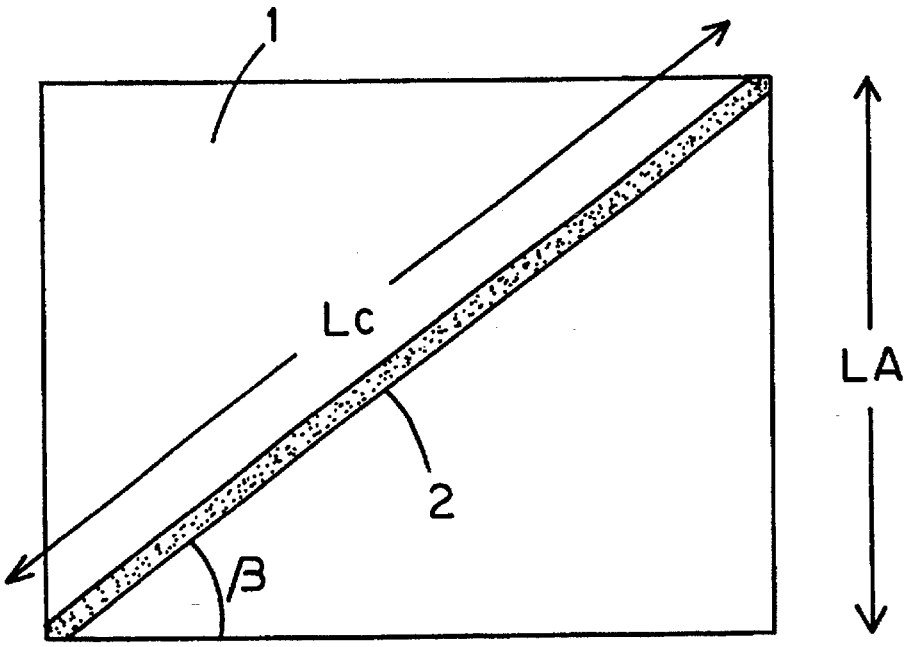
FIG. 2*a*: shows a sheet of dielectric material for a monofilar helix antenna having a single conductor affixed thereto (shown before furling).
Figure 3:
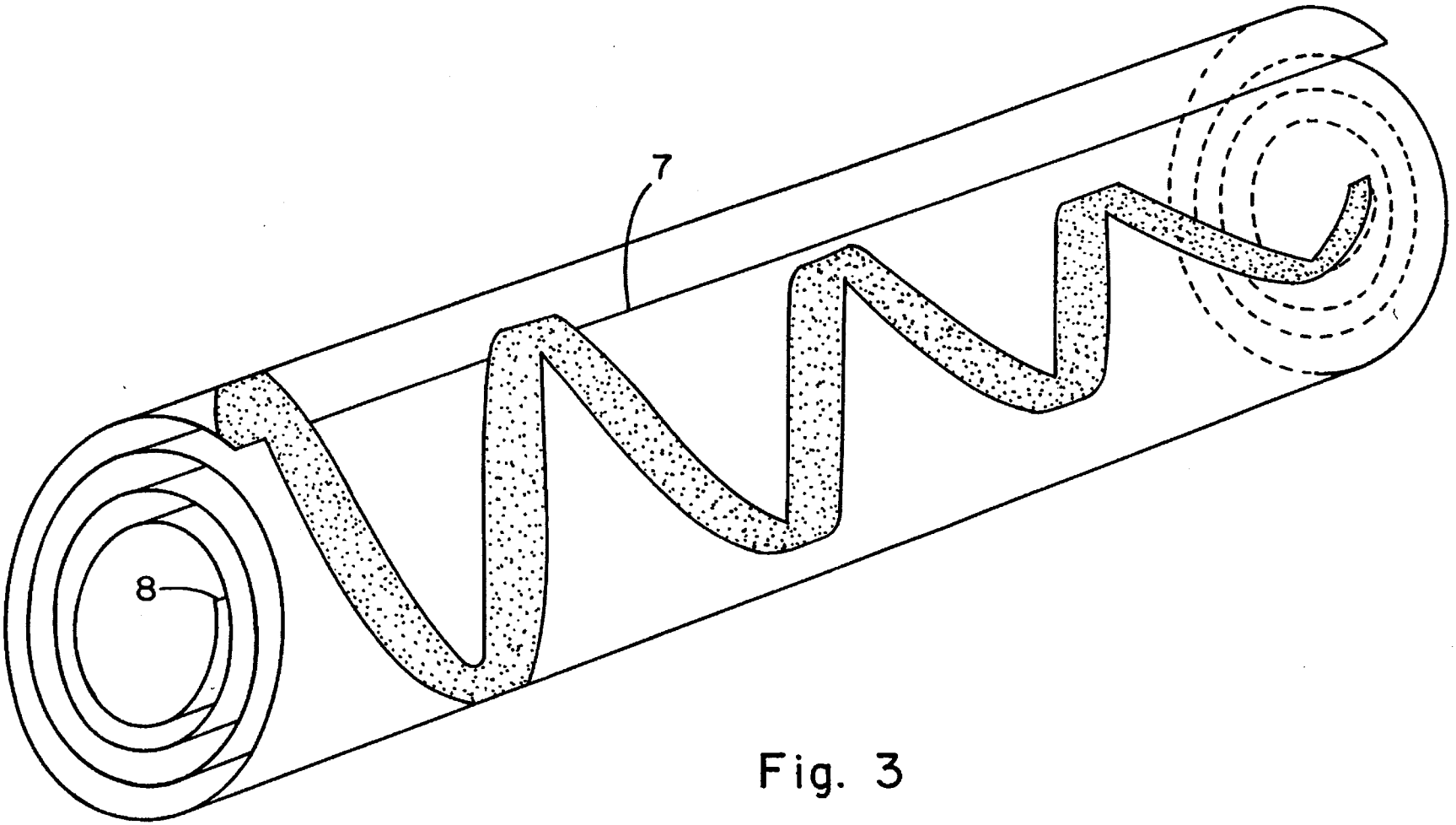
FIG. 3: shows the helix antenna formed when furling the dielectric sheet shown in FIG. 2*a*.

FIG. 2*a* shows a dielectric sheet used to form the antenna shown in FIG. 3 (prior to furling). For the monofilar embodiment shown in FIG. 2*a* a single conductor 2 is secured to dielectric sheet 1. The conductor 2 may consist of a thin copper strip affixed to dielectric sheet 1 by adhesive etc. Alternatively, a copper/dielectric laminate may be etched to form the required shape of conductor 2 and any associated elements.

Figure 2B:
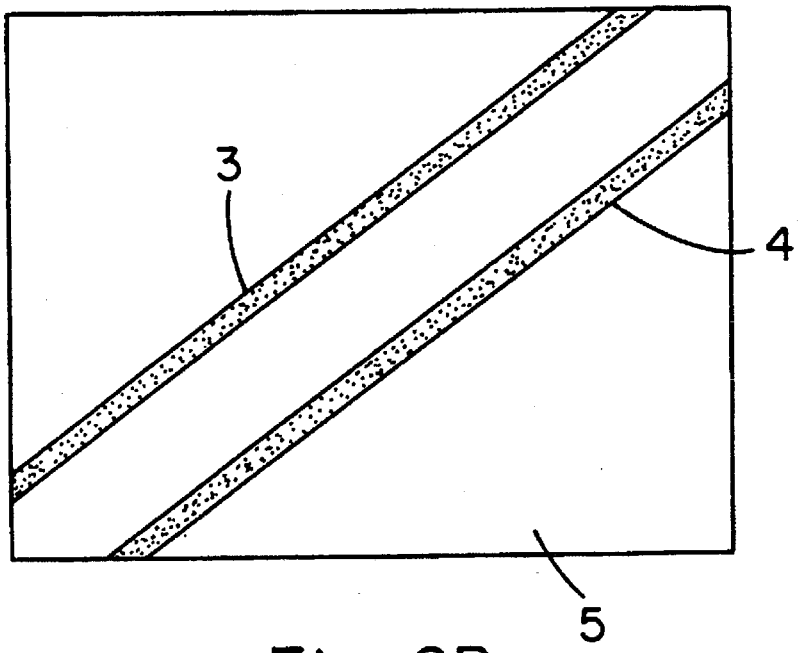
FIG. 2*b*: shows a sheet of dielectric material for a bifilar helix antenna having two conductors secured thereto (again shown before furling).

FIG. 2*b* shows a bifilar embodiment. In this case two conductors 3 and 4 are affixed to dielectric sheet 5. The conductors 3, 4 are preferably parallel and spaced such that they are symmetrically positioned about the antenna when furled. Other multifilar antennas may have further conductors, such as a quadrafilar helix antenna having four evenly spaced conductors affixed to the dielectric sheet in a similar way. The conductors may be fed from either the top or bottom of the antenna. The conductors should be so spaced that when furled the conductors form evenly spaced helixes, at least in one configuration. $L_A$ indicates the antenna length and $L_C$ indicates the conductor length.

Figure 4A:
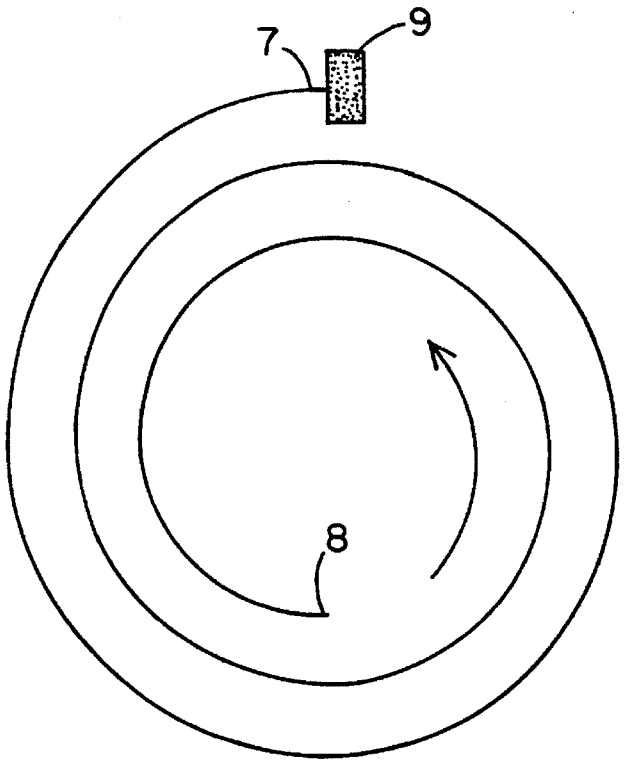
FIG. 4*a*: shows schematically in cross-section an antenna of the form shown in FIG. 3 where the outer side of the dielectric sheet is fixed and the inner side of the dielectric sheet is moveable.
Figure 4B:
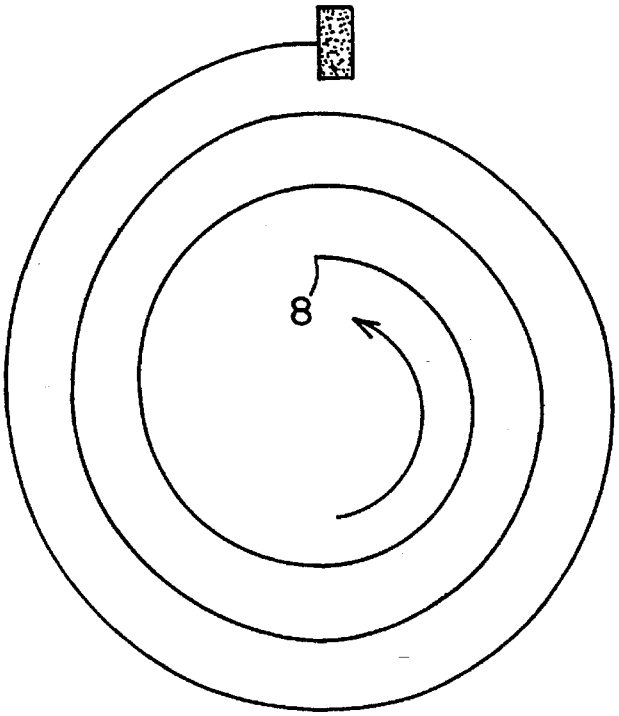
FIG. 4*b*: shows the antenna of FIG. 4*a* furled a further half turn.

FIG. 3 shows the dielectric sheet and conductor of FIG. 2*a* furled to form a helix antenna. By rotating outer side 7 with respect to inner side 8 the antenna may be furled or unfurled. Thus, the number of turns of the spiral may be varied. FIGS. 4*a* and 4*b* show schematically the rotational furling and unfurling of the antenna of FIG. 3. Outer edge 7 is fixed at point 9. FIG. 4*b* shows the inner side 8 rotated a half turn from the position shown in FIG. 4*a*. The dielectric sheet 1 should be sufficiently thin that the radius of caviture along a fixed spiral is essentially constant. A small taper in fact exists along the length of the helix antenna due to the finite thickness of the dielectric sheet. This does not however substantially affect the electrical behaviour of the helix antenna.

By altering the number of turns of the helix antenna by the rotational furling action shown in FIGS. 4*a* and 4*b* the length $L_A$ of the antenna and its pitch angle remain constant whilst the radius and pitch p change. The variation of these antenna parameters varies the radiation pattern of the antenna at a constant frequency of operation.

Figure 5A:
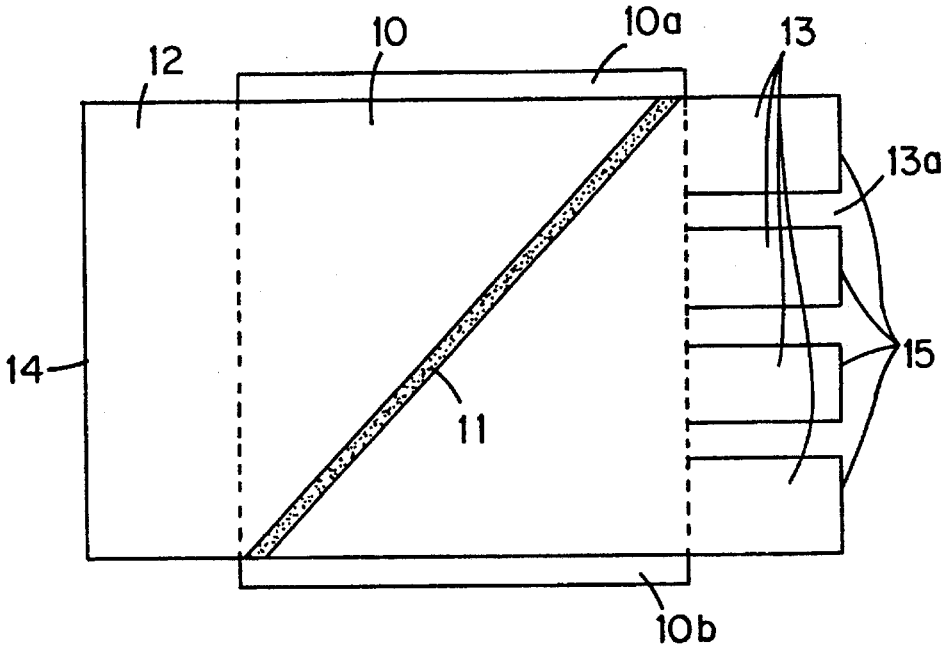
FIG. 5*a*: shows a sheet of dielectric material before furling having excess dielectric sheet beyond the ends of the conductor.
Figure 5B:
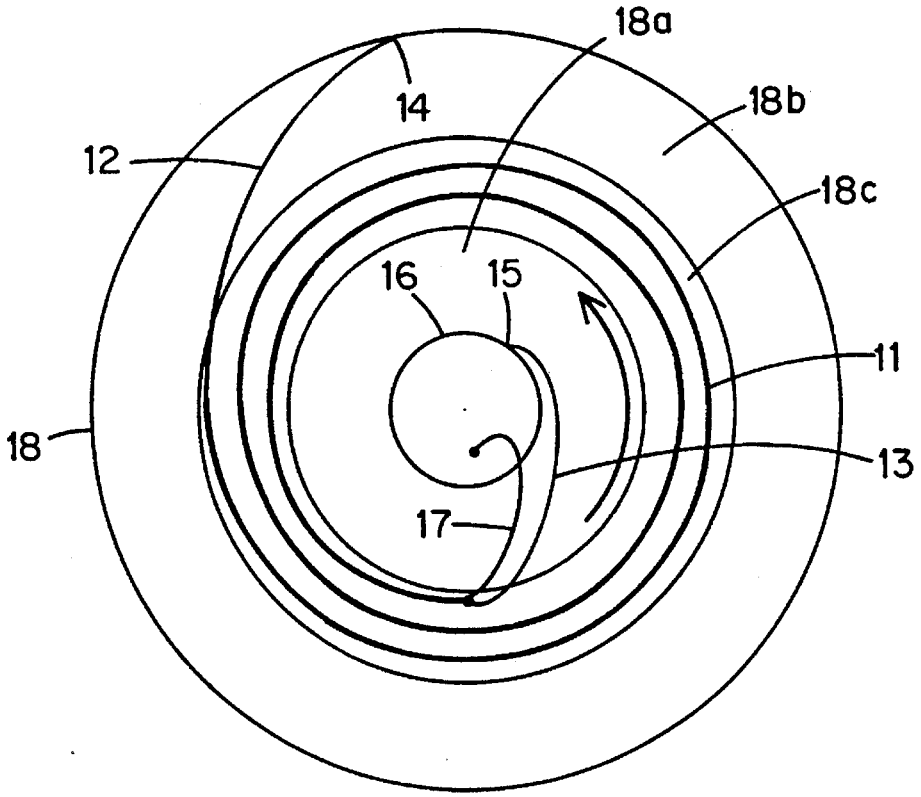
FIG. 5*b*: shows in cross-section an antenna formed from the sheet shown in FIG. 5*a*.

FIGS. 5*a* and 5*b* show a further form of antenna of the invention. A conductor 11 is again affixed to portion 10 of a dielectric sheet. In this case however excess dielectric sheet is provided at either side of the dielectric sheet (portions 12 and 13). Excess dielectric sheet 10*a* and 10*b* is also provided at the top and bottom of dielectric sheet 10. FIG. 5*b* shows an actual construction using the dielectric sheet shown in FIG. 5*a*. The inner sides 15 of portions 13 are affixed to a central tube 16.

A feed line also passes up central tube 16 with feed line 17 connecting conductor 11 to the main feed line. The outer side 14 of dielectric sheet is affixed to radome 18. Rotation of radome 18 with respect to central tube 16 thus enables furling and unfurling of the dielectric sheet. This enables parameters of the antenna to be adjusted to steer the antenna beam. Rotation of the radome is preferred as the central tube contains the coaxial feedline for a top feed antenna, which would be difficult to rotate. Feed line 17 should be of sufficient length to allow for movement during furling and unfurling.

Collars 18*a* and 18*b* provided in the base of the antenna form a groove 18*c* therebetween. Collars 18*a* and 18*b* may be formed from a single dielectric disc with an annular groove formed therein to provide groove 18*c*. Portion 10*b* of the dielectric sheet is located within groove 18*c* to contain portion 10 of the dielectric sheet within the radial limits defined by the groove. Portions 14 and 15 ride on top of collar 18*b*. A plurality of collars 18*a* may be provided along central tube 16 to reduce the radial separation of the conductor turns and provide dampening. Slots 13*a* may be provided in portion 13 so that the compressible collars 18*a* along central tube 16 do not prevent portion 13 from connecting to tube 16. The compressible collars 18*a* may preferably be formed of polythene foam. It will however be appreciated that other means may be used to bias the portion 10 of the dielectric nearest central conductor 16 beyond the minimum radius. A similar guide groove to 18*c* may be provided at the top of the antenna also to guide the sheet. It will be appreciated that the radius of collars 18*a* and 18*b* will determine the maximum and minimum possible antenna radii.

It will be seen that by providing excess dielectric sheet 12 and 13 the portion of dielectric sheet carrying conductor 11 can be maintained in a substantially cylindrical form. This avoids distortion of the helix close to the central tube and radome. It will be appreciated that the antenna of the invention may be mounted and adjusted in a number of ways. For example, the dielectric sheet could be supported at a number of points with the positions of the points of support being manipulated to adjust the antenna to the required configuration. Hydraulic, pneumatic or mechanical driving means could be used to adjust the configuration of the antenna.

It should also be appreciated that the dielectric sheet may be of a shape other than rectangular, although the preferred form of the invention is rectangular. For long antenna for example a strip of dielectric could run substantially co-axial with the conductor. This strip would then be helically wound to form an antenna. This would avoid the need for wide sheets of dielectric material for long antennae.

It is also to be appreciated that the antenna may be other than cylindrical. Planar or conical forms could also be used, depending upon the particular application. See for example varying (multiple) loop planar spiral antennas at page 699 of Kraus and conical spiral antennas at page 702 of Kraus. The antennae may also be arranged in Maxwell dual forms of the structures disclosed, including those where the dielectric sheet is interchanged with conductor and the conductors interchanged with slots or dielectric, and including any hybrid forms or implementations.

Figure 6:
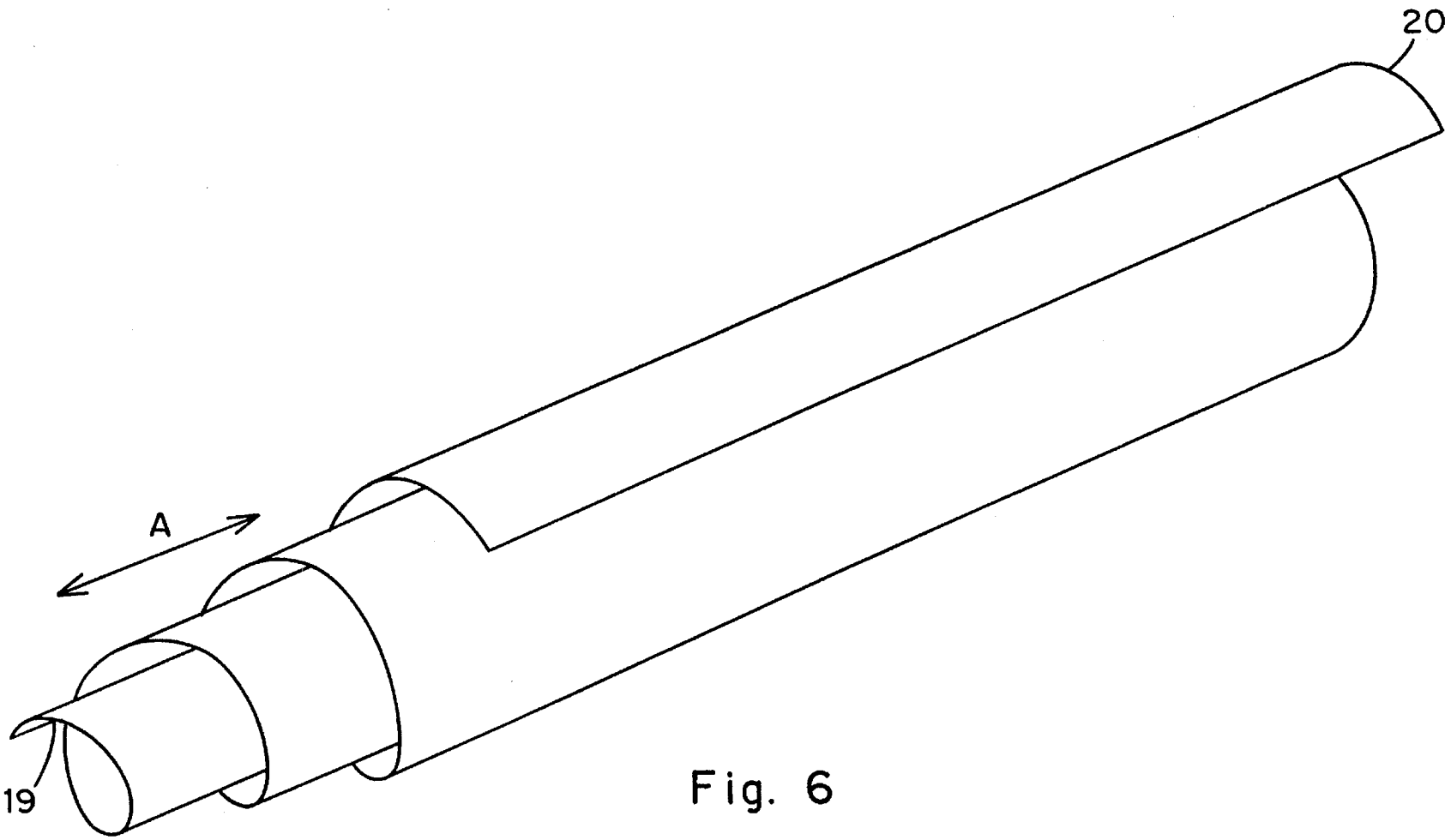
FIG. 6: shows schematically axial unfurling of an antenna of the form shown in FIG. 3.

FIG. 6 illustrates a method of axial unfurling to alter the parameters of the helix antenna. The antenna may be generally of the form shown in FIG. 3. Rather than rotating one edge of the dielectric sheet relative to the other (rotational unfurling) FIG. 6 illustrates axial unfurling in which one end 19 of the antenna is moved axially towards or away from another end of the antenna 20. Arrow A indicates the axial direction of movement. Such axial unfurling alters the relationship of the terms of the antenna and also produces steering of the antenna beam. Such axial unfurling may be used either alone or in combination with rotational unfurling. Axial unfurling enables the antenna length to be varied whilst keeping other parameters such as the number of turns, constant.

It will be appreciated that for multifilar embodiments the conductors will only be evenly spaced in one optimum configuration. As the antenna is furled or unfurled the conductors will move closer together. By interleaving multiple dielectric sheets the symmetry of the interleaved conductors may be better preserved.

Figure 7:
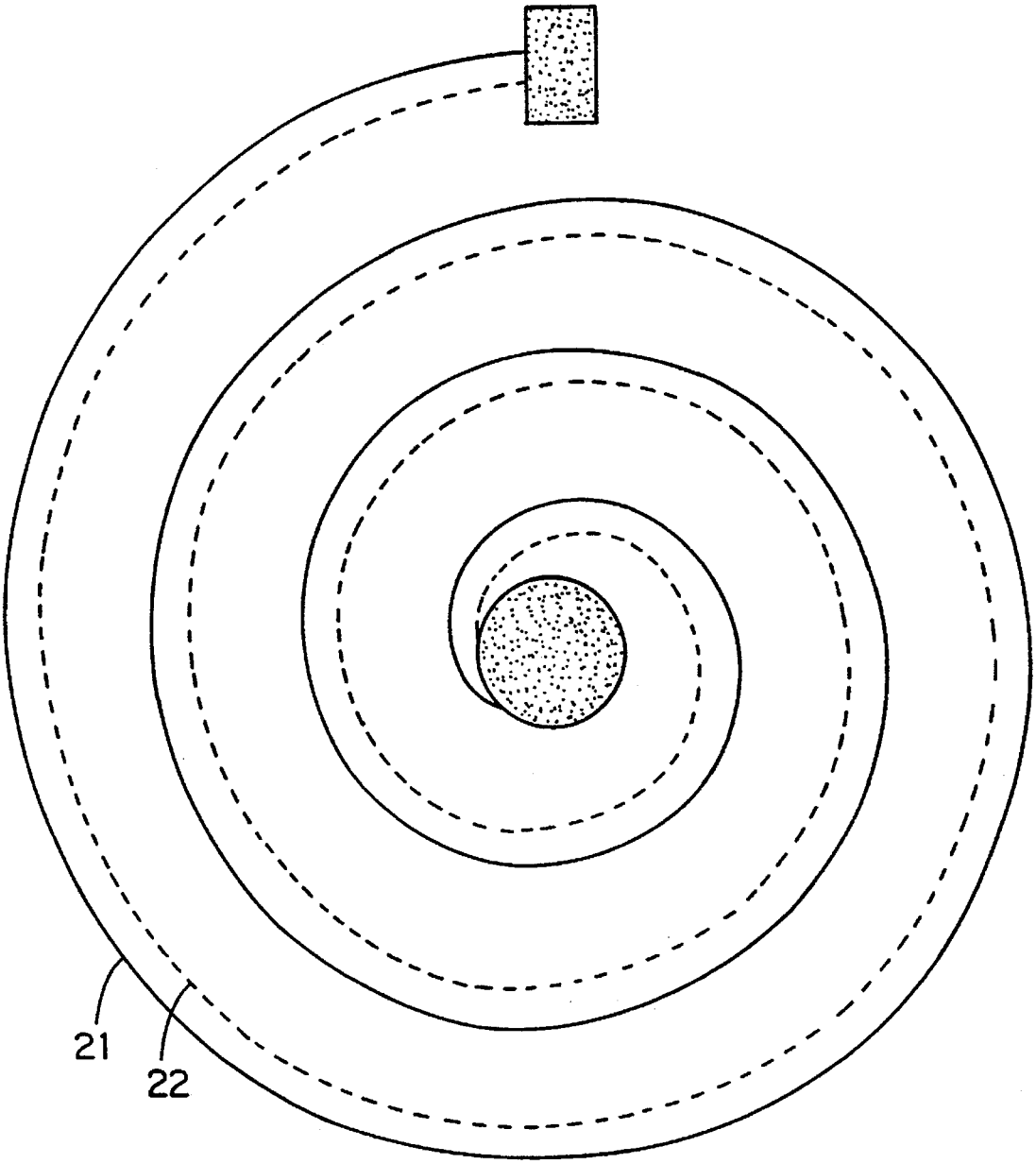
FIG. 7: shows in cross-section a bifilar antenna consisting of two interleaved sheets of dielectric material.

In a purely illustrative example FIG. 7 shows two interleaved dielectric sheets 21 and 22 furled to form a multifilar helix antenna. The sheets will be so positioned that the conductors are evenly spaced apart when furled.

To ensure that symmetry is maintained the sheets may be furled and unfurled separately. For example, a mechanical linkage could be used which moves the end of one dielectric sheet in fixed proportion to the end of the other dielectric sheet. In another embodiment the ends of the dielectric sheets could be rotated through geared mechanisms connecting to stepper motors, which could advance in predetermined relationships (stored in memory) to ensure than symmetry of the conductors is preserved. This results in the azimuth radiation symmetry being maintained as the elevation angle is adjusted.

Figure 8A:
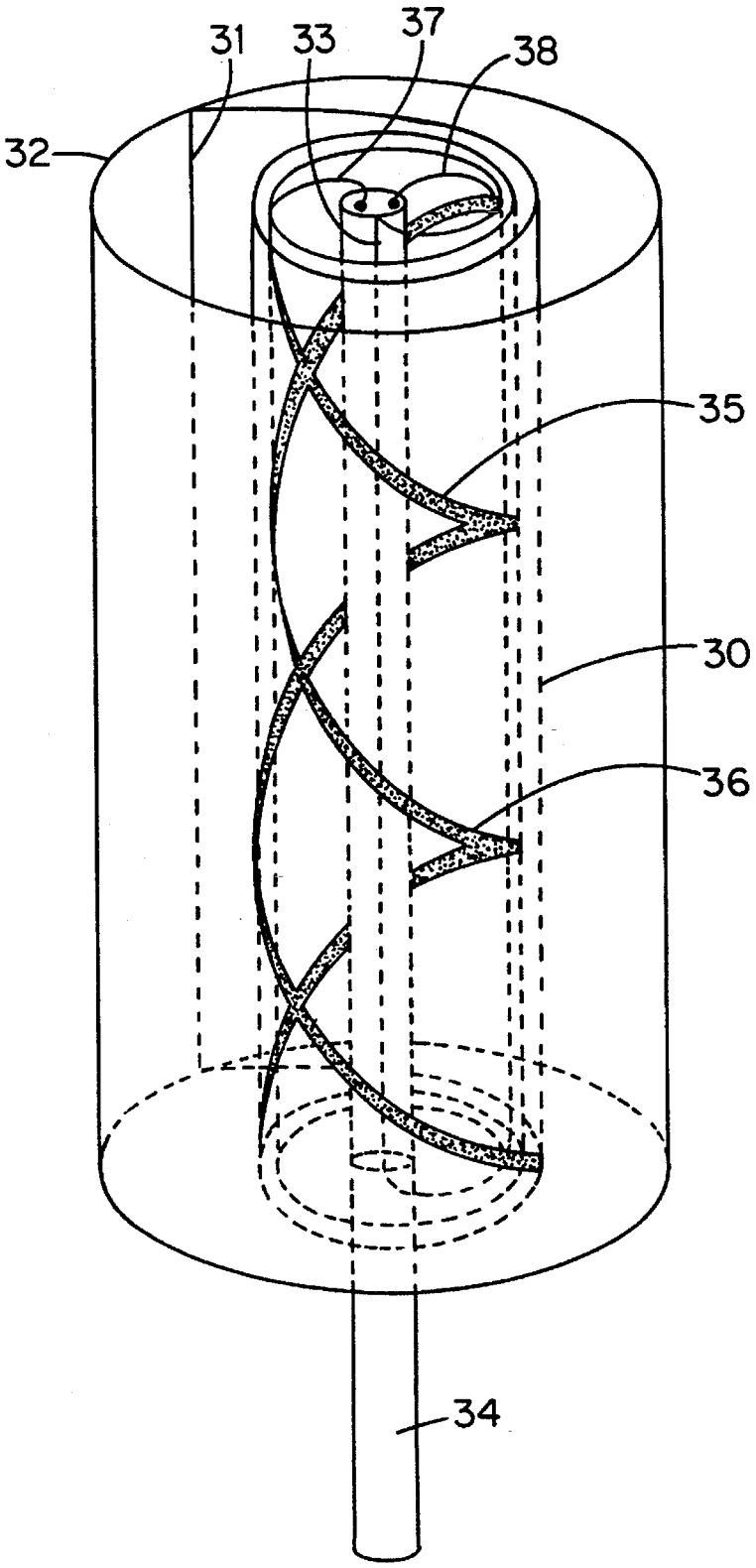
FIG. 8*a*: shows a bifilar antenna including a central tube and surrounding radome.

FIG. 8*a* shows a bifilar antenna having a construction similar to the antenna of FIG. 5. The bifilar form is the preferred form as it provides the advantages of a multifilar antenna without the conductor spacing problems experienced in antennae with more conductors (i.e. with an increased number of conductors it is more difficult to maintain an even spacing between conductors). The outer side 31 of dielectric sheet 30 is affixed to radome 32 and the inner side 33 of dielectric sheet 30 is affixed to central tube 34. Feed lines pass through central tube 34 and feed the conductors 35 and 36 via feed lines 37 and 38 respectively. If necessary baluns and matching may be provided at the top of the antenna, at the feed-line-to-conductor interface.

Figure 8B:
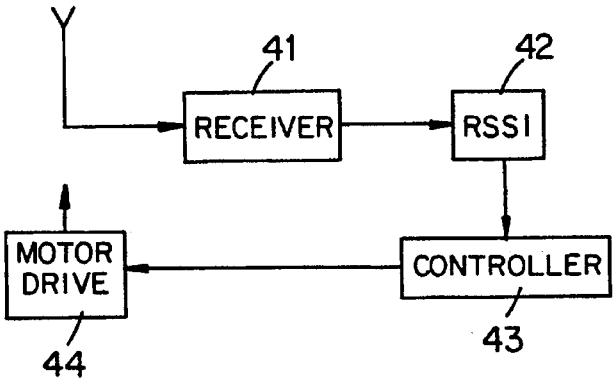
FIG. 8*b*: shows in block form a possible controller suitable for rotating the radome of the antenna shown in FIG. 8*a*.

In a preferred embodiment matching elements consisting of metal conductors may be affixed to the dielectric sheets in electrical connection with the conductors adjacent the point of connection between the feed lines and the conductors. FIG. 8*c* shows an embodiment including matching elements affixed to the dielectric sheet. Conductors 23 and 24 are connected at the bottom by conductor 25. A matching network at the top of the dielectric sheet is shown within dashed box 26.

It will be appreciated that reactive load elements may also be provided on the dielectric sheet for frequency scanning compensation. Referring now to FIG. 8*d* the dielectric sheet and conductors for an anti-scanning embodiment is shown in its unfurled state. This embodiment is the same as that shown in FIG. 8*c* except that a plurality of anti-scanning networks 70 are provided along the length of conductors 71 and 72. Referring to FIG. 8*e* a first possible anti-scanning network is shown. This is a lumped network including a capacitance and an inductance. The inductance is formed by a U-section 73 connected to conductor 71, 72 at corners 75, 76. A capacitance is formed by a metal strip 74 above and separated from the corners 75 and 76 by a strip of dielectric material.

Figure 8H:
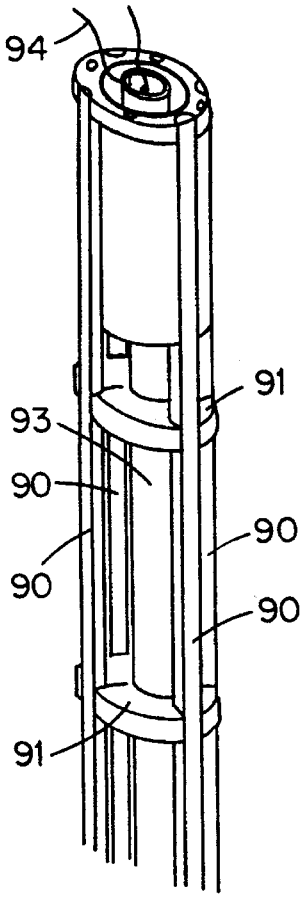
FIGS. 8H, 8J, and 8I: show a balun and impedance matching network at the top of the central tube.
Figure 8J:
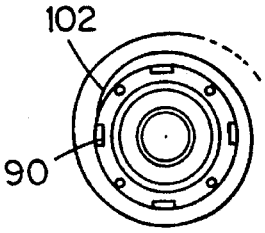
Figure 8I:
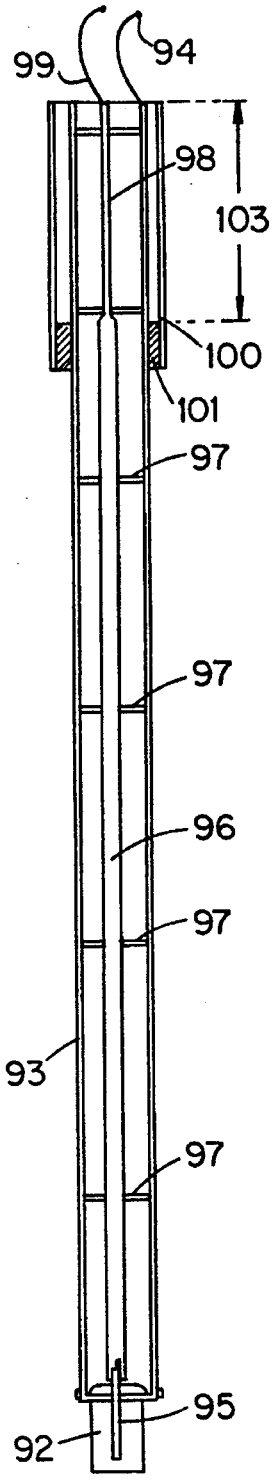
Figure 8C:
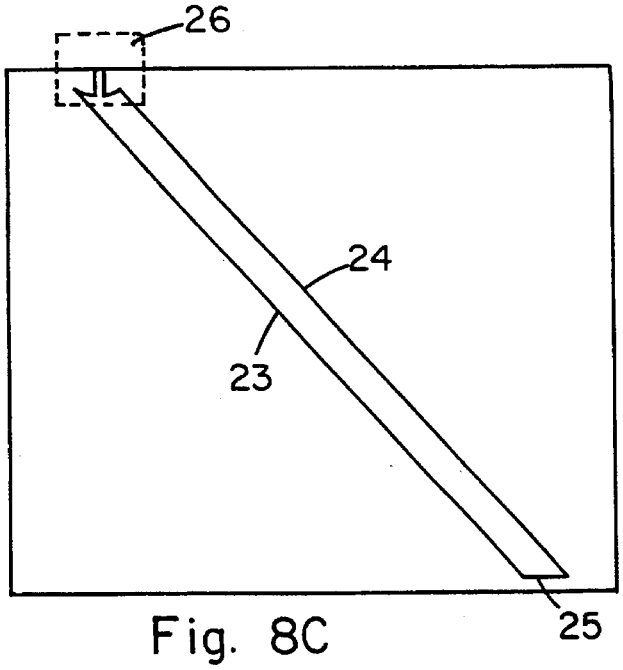
FIG. 8*c*: shows a dielectric sheet for a bifilar embodiment including a matching network.
Figure 8D:
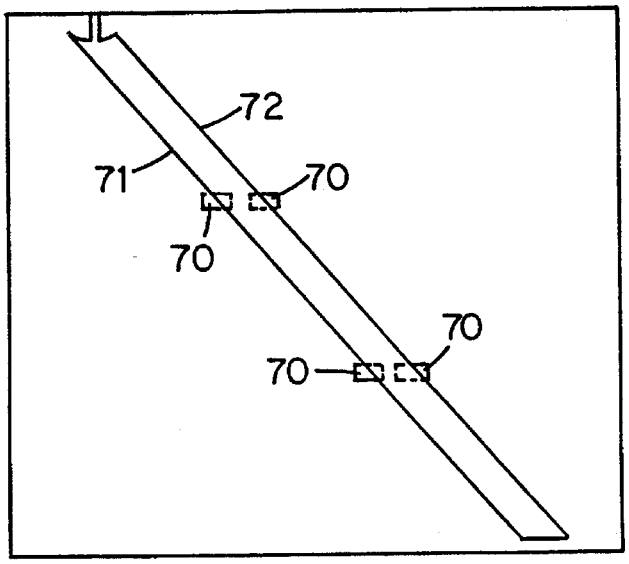
FIG. 8*d*: shows a dielectric sheet for a bifilar embodiment including anti-scanning networks.
Figure 8E:
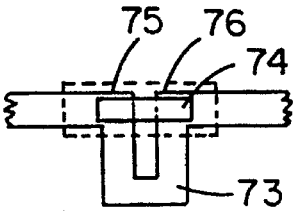
FIGS. 8*e* to 8*g*: show possible anti-scanning networks for the embodiment of FIG. 8*d*.
Figure 8F:
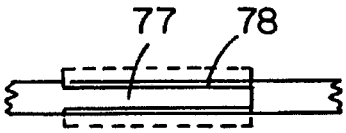
Figure 8G:
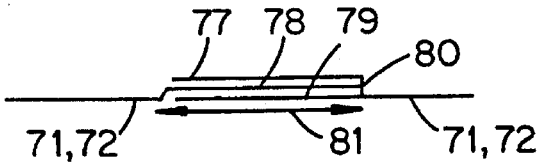

Alternatively, the anti-scanning network may be a distributed network as shown in plan in FIG. 8*f* and in elevation in FIG. 8*g*. Three conductive plates 77, 78 and 79 are provided on the dielectric sheet with dielectric material being provided between conductive plates 77, 78 and 79. Plates 77, 78 and 79 are all electrically connected at point 80 to conductor 71, 72. Only the middle conductive plate 78 is connected to the other side of conductor 71, 72. The length 81 of the network will preferably be a quarter wavelength midway between the receive and transmit bands. A combination of the lumped and distributed networks may also be provided.

Such anti-scanning networks help to reduce scanning by the antenna beam as the operating frequency changes. The conductors and load elements may be formed simultaneously when formed by etching a sheet of copper coated dielectric.

When the conductors are formed by etching they may be of varying width along their length without affecting the generally helical shape of the conductors (as would be the case with springs). If required, the conductors may follow a non helical path. As the rigidity of the structure is given by the dielectric sheet the conductors can follow any required path.

Radome 32 (see FIG. 8*a*) may be manually rotated with respect of central tube 34 at manufacture or on site. Where dynamic variation is required, for example when the antenna is mounted to a vehicle, an automatic beam steering means may be provided. The radome 32 may be rotated relative to central tube 34 by suitable drive means, such as electric motor or hydraulic motor, geared appropriately and controlled by a controller. A possible controller arrangement is shown in FIG. 8*b* in block diagram form. The signal from the receiver 41 is supplied to a received signal strength indicator RSSI 42 to determine the strength of the signal. RSSI 42 supplies a signal to controller 43 indicative of the strength of the received signal. Control 43 drives drive means 44 to rotate radome 32 in response to the signal strength information received. For example, if the signal strength increases in one direction of rotation the controller will continue to rotate the radome in that direction. Once the radome has been rotated past the point of maximum signal strength it will then be rotated back to the point of maximum signal strength. The antenna may then be periodically adjusted to optimise the beam direction.

Typical dimensions for a bifilar antenna as shown in FIG. 8*a* are as follows:

Helix pitch angle—50°

Diameter—22 to 28 mm

Length—about 600 mm

The length, and hence number of turns, may be selected to achieve the desired directivity. The pitch angle can vary over the range 25° to 70°. The preferred pitch angle is however in the range 45° to 65°. The diameter adjustment range has to be chosen for a particular pitch angle to achieve the desired main lobe elevation adjustment range. The preferred dielectric material is Mylar film (polyethyleneterephalate) of about 0.12 mm thickness.

FIGS. 8H, 8J, and 8I show a possible feed arrangement for the helical antenna of FIG. 8*a*. FIG. 8*h* shows a perspective view, FIG. 8*j* shows a cross-sectional view along the axis of the central tube and FIG. 8*k* shows an end view.

The central tube 34 of FIG. 8*a* is indicated by numeral 93 and is surrounded by a skeleton dielectric tube made up of dielectric bars 90 which are held apart in spaced relationship by dielectric spacers 91. The outer conductor of BNC socket 92 is electrically connected to electrically conductive rod 93. A feed line 94 is connected to the top of electrically conductive tube 93. The internal conductor 95 of the BNC socket is connected to electrically conductive rod 96 which passes through the middle of electrically conductive tube 93. Dielectric spacers 97 keep electrically conductive rod 96 in spaced relation from electrically conductive tube 93. At the top of central tube 93 rod 96 reduces to a smaller diameter 98. This forms a transformer for impedance matching. The other dielectric conductor feed line 99 is connected to the top of rod 98. A balun in the form of tube 100 is provided about the top of tube 93 connected electrically and held in place by conductive sleeve 101. The length of the balun 103 is preferably a quarter wave length. Electrically conductive rod 93 is preferably formed of brass and electrically conductive rod 96 is preferably formed of copper. The skeleton dielectric tube may be formed of polythene, Unibrite™ (Acrylonitrile-EPDM-styrene terpolymer), PVC or nylon ABS. Dielectric spacers 97 are preferably formed of polythene, polytetraflouroethylene or polystrene.

The skeleton assembly shown in FIG. 8*h* allows easy attachment of the dielectric sheet. Tabs formed on dielectric sheet 102 may be secured within slots in bar 90. The diameter of the skeleton dielectric tube is slightly smaller than the smallest diameter required by the helix antenna. As the dielectric tube does not comprise much dielectric material, it does not affect the radiation pattern, even when dielectric 102 is wound to its smallest diameter.

A skeleton dielectric tube may also be provided between the dielectric sheet and the radome. It may in some cases be difficult to attach the dielectric sheet to the radome whilst maintaining the radomes environmental protection function. In this case the outer side of the dielectric is secured to the skeleton dielectric. The skeleton dielectric may be rotated, rather than the radome, to adjust the antenna.

Figure 9A:
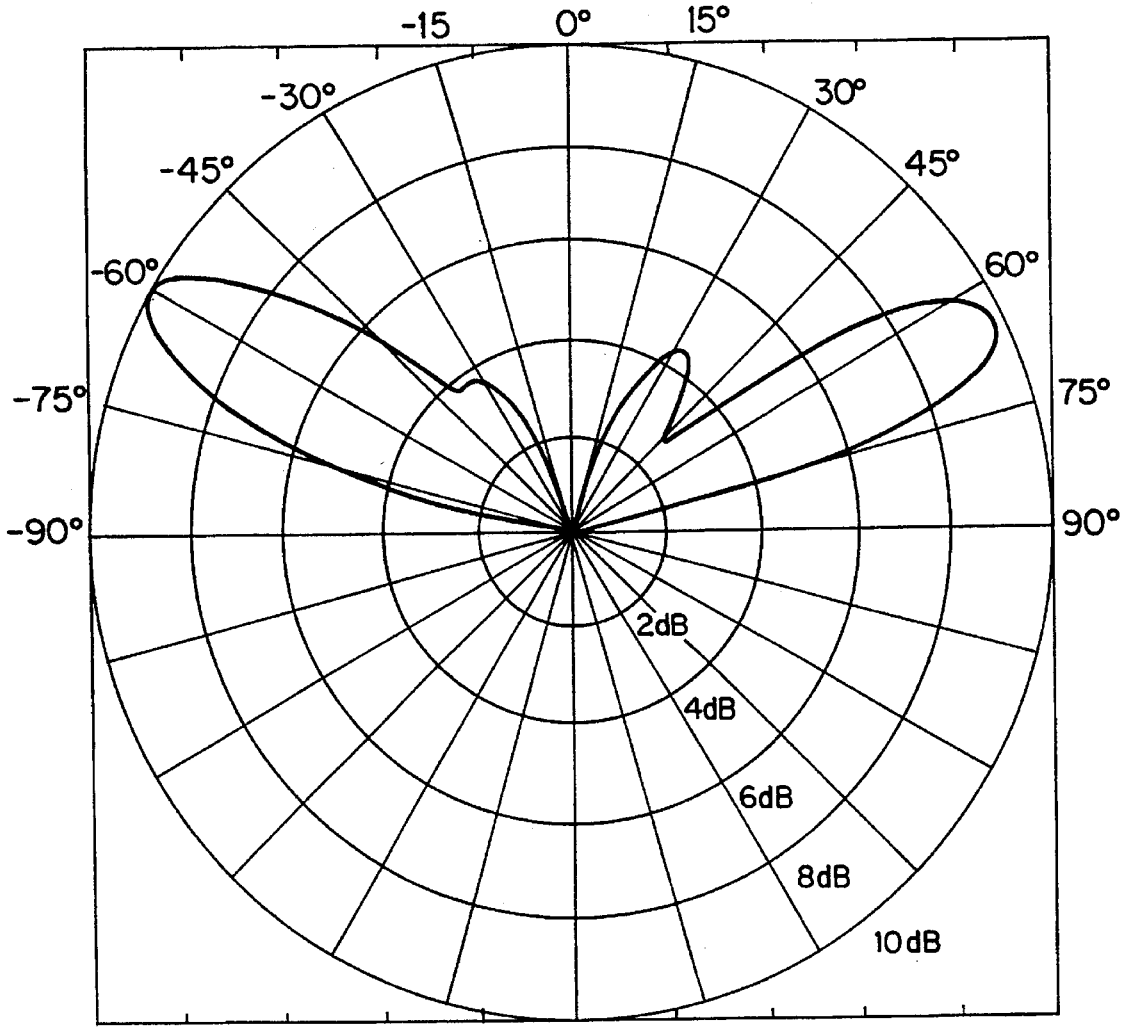
FIGS. 9*a* to 9*d*: show radiation patterns measured from a prototype antenna of the invention similar to that shown in FIG. 8*a*. The radiation patterns show the antenna beam being steered, by manipulation of the antenna, to a zenith angle of about 62° in FIG. 9*a*; about 50° in FIG. 9*b* and about 15° in FIG. 9*c*.
Figure 9B:
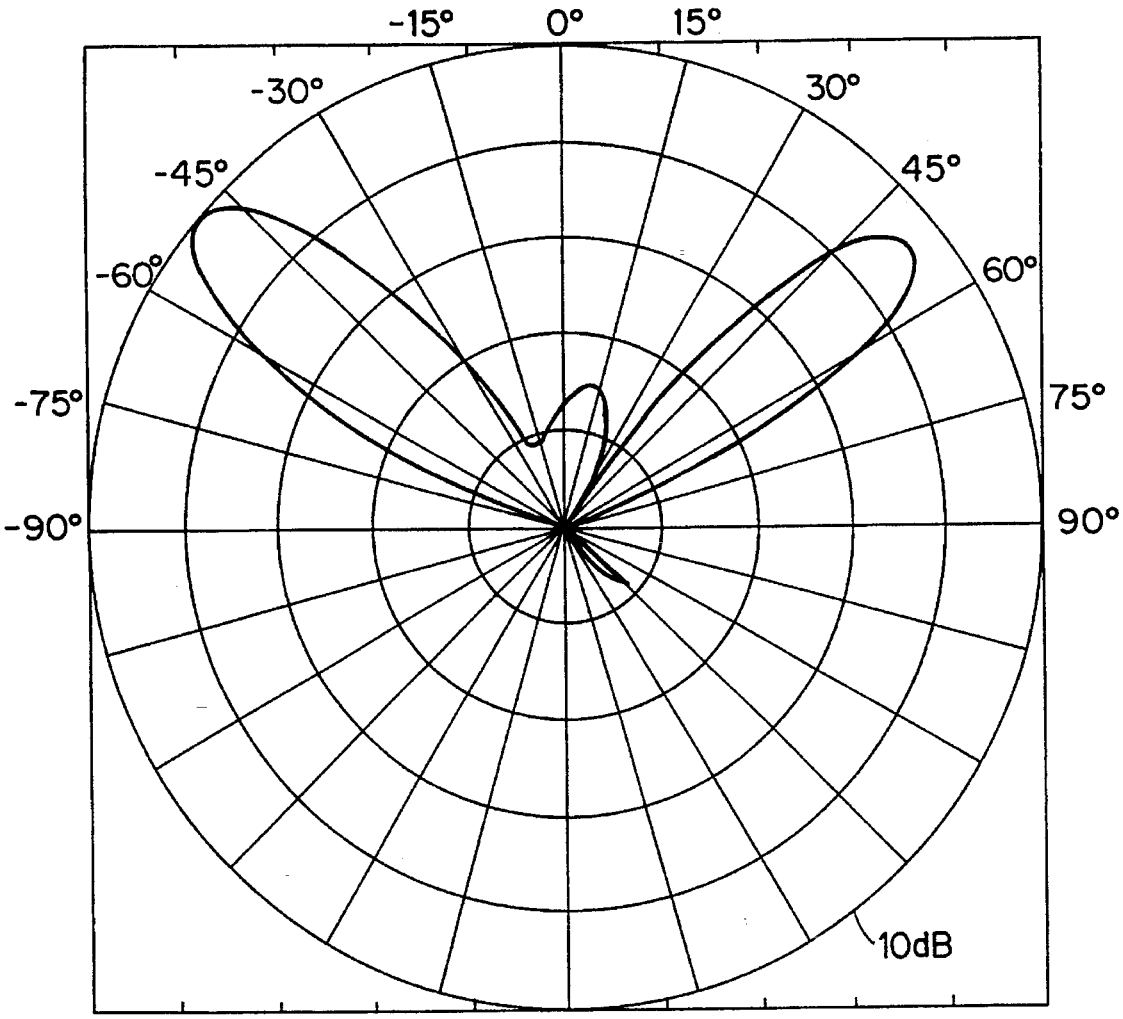
Figure 9C:
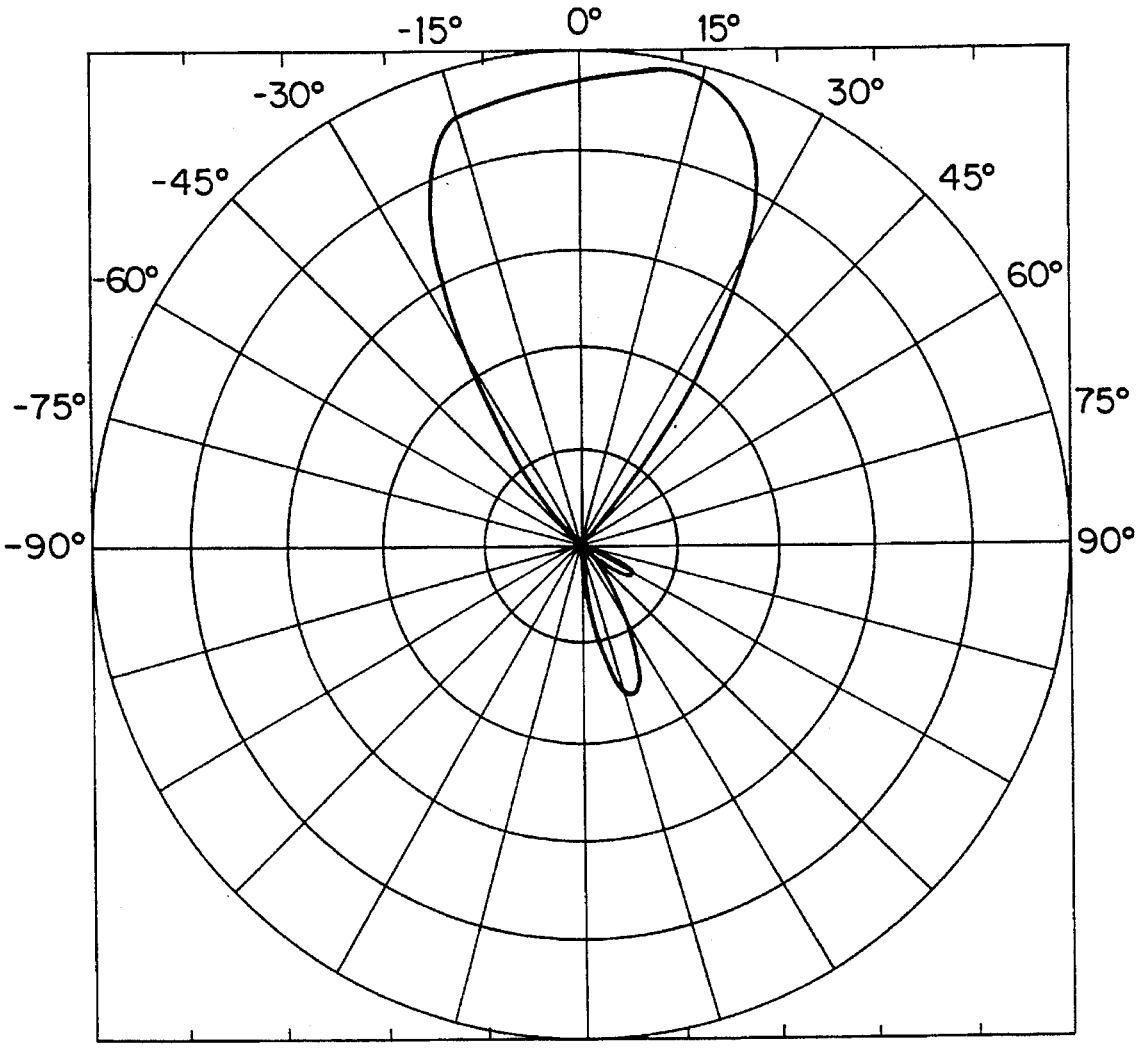

FIGS. 9*a* to 9*d* give radiation patterns for the antenna of FIG. 8*a* for various rotational settings of the radome, when operating at a constant frequency. The scale is 10 dB from outer ring to centre point in FIGS. 9*a*, 9*b* and 9*c* and 30 dB in FIG. 9*d*. The radiation pattern of the main beam is essentially rotationally symmetric and essentially circularly polarised. The radiation patterns shown in FIGS. 9*a*, 9*b* and 9*c* are for representatives settings (5.5, 6.5 and 8 turns respectively) of the helix, with a pitch angle of 50° and a length of three wave lengths. The gain is about 6 dBi referenced to circular.

Figure 9D:
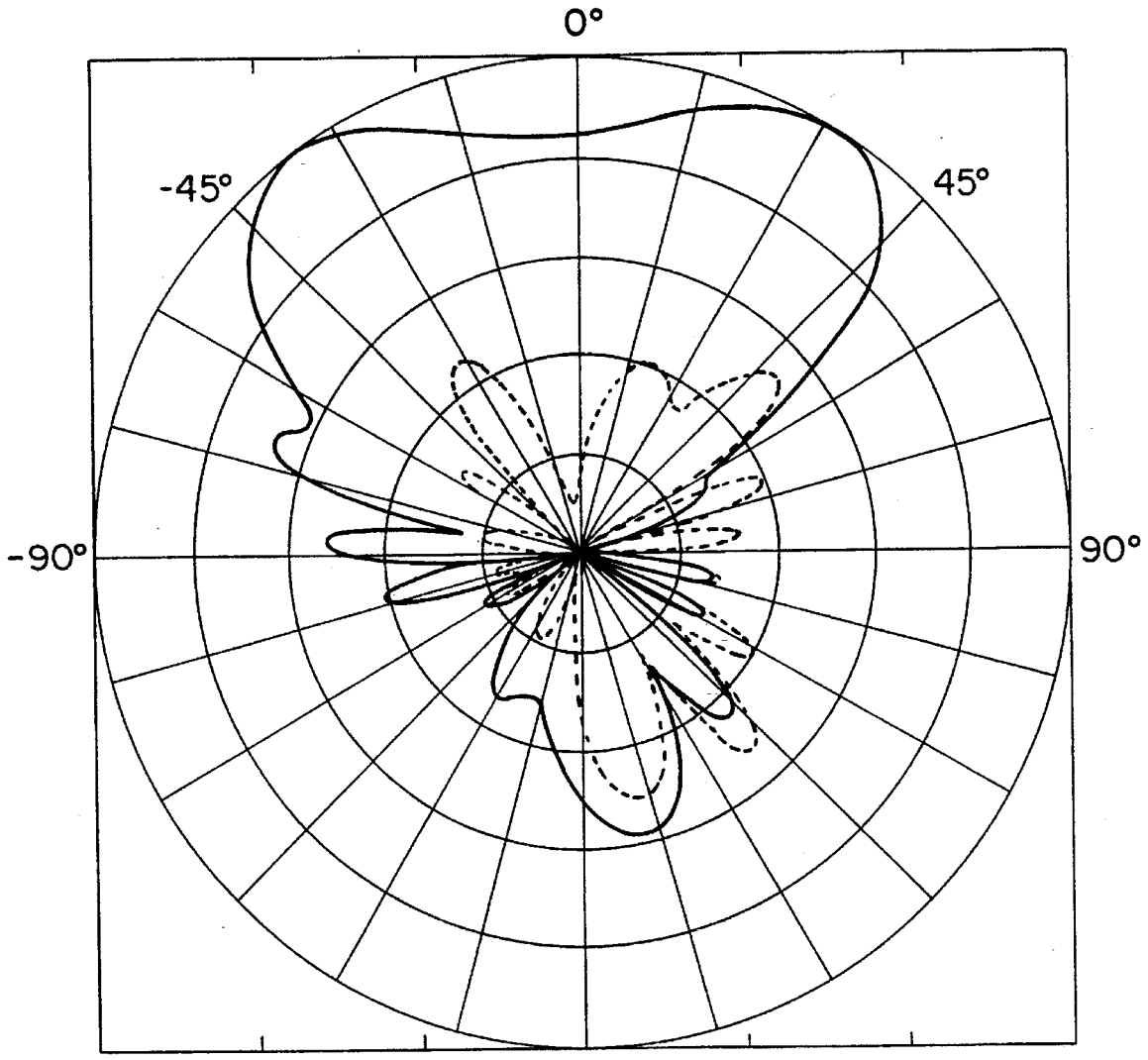

FIG. 9*d* is the measured co- and cross-polarisations for a similar prototype, but with a pitch angle of 62°, and indicates that the crossed polar component is more than about 17 dB below the co-polar, giving a very small polarisation mismatch loss of less than 0.1 dB. The radiation patterns in FIGS. 9*a* to 9*c* illustrate the beam steering capabilities of the antenna of the invention while FIG. 9*d* demonstrates the typical polarisation purity.

Figure 10:
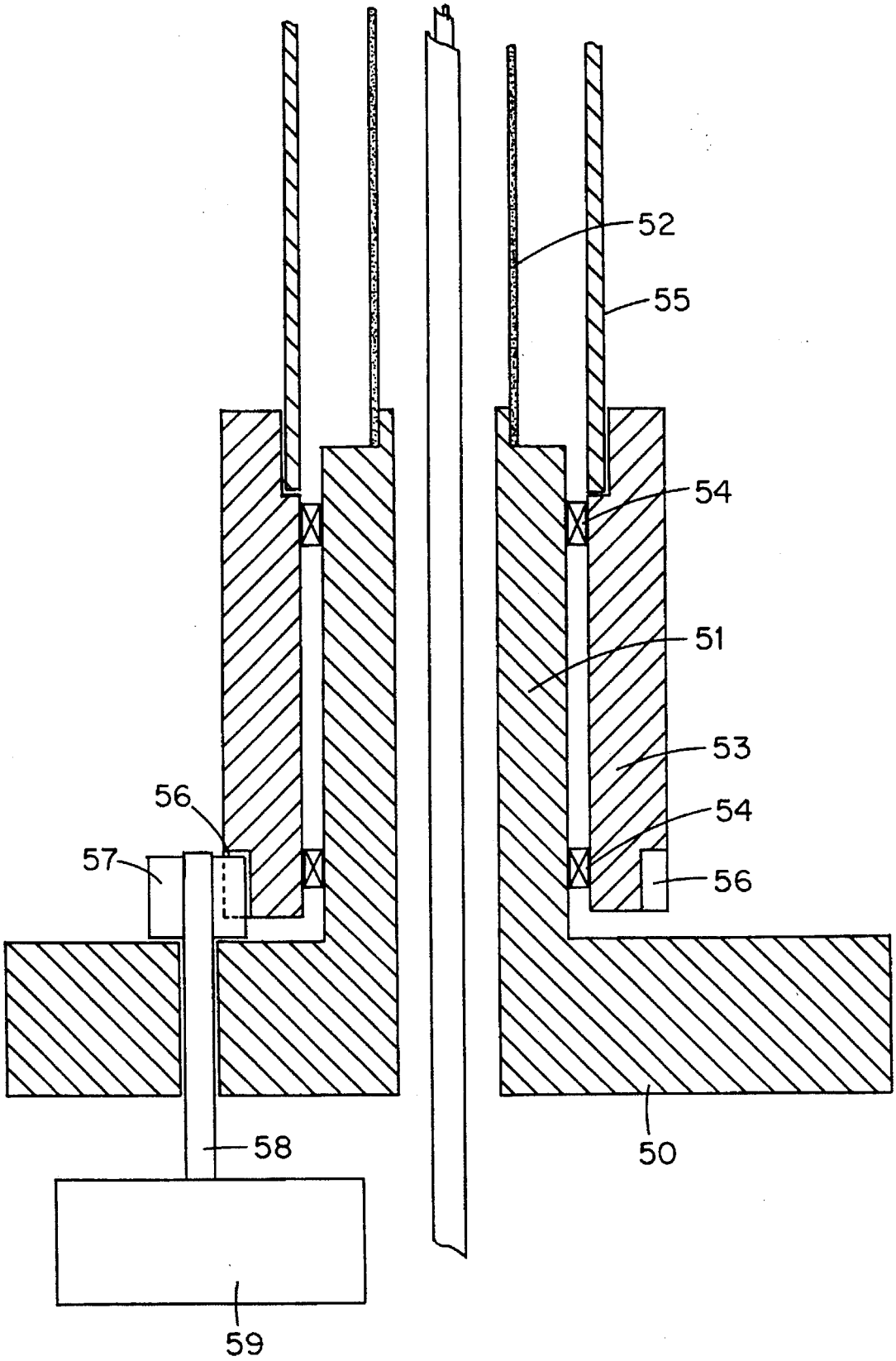
FIG. 10: shows schematically one arrangement for adjusting the antenna using a motor drive.

FIG. 10 shows a drive arrangement for a helical antenna of the invention, such as that shown in FIG. 8. A base 50 includes a tubular portion 51 which supports a central tube 52. An outer sleeve 53 is rotatably mounted with respect to base 50 through bearings 54, such that sleeve 53 can rotate relative to base 50. The sleeve 53 supports radome 55 of the antenna. A gear 56 is formed about the outer periphery of sleeve 53. A pinion gear 57 engages with peripheral gear 56 and is rotated via shaft 58 which is connected to drive means 59.

In operation drive means 59 rotates shaft 58 which rotates pinion 57 and thus rotates sleeve 53 via gear 56. The controller driving the drive means may for example be as shown in FIG. 8*b*. It will be appreciated that many other possible mounting arrangements and driving arrangements can be employed to furl and unfurl the antenna of the invention. For example, a belt drive mechanism could contact the exterior of the radome to rotate it. Further, a pneumatic piston or a rack and pinion arrangement could be used to axially unfurl the antenna by moving one end of the antenna relative to the other.

Where the term helix antenna is used in this specification it is to be understood that reference is being made to an antenna in which the conductor or conductors are of generally helical form. The antenna may taper towards one end, the thickness of the conductors may vary along the length of the conductor and the pitch of the conductors may vary throughout the length of the antenna. The term is thus used in a very general sense.

It is also to be appreciate that whilst the invention has been described with reference to a scanning mode helix antenna, the structure described may find application in other modes of operation. For example, the normal mode or axial mode of operation can be implemented with the invented structure, and the adjustment mechanism can be used to set the antenna dimensions to suit working requirements such as operating frequency, impedance, gain or pattern shape. A principal advantage of the antenna herein described is that the conductors of the antenna are kept in constant fixed axial relationship regardless of any vibration or jolting of the antenna structure. The construction of the present invention also allows antenna structures having variable parameters which could not be implemented using spiral spring helical conductors. The antenna structure of the present invention allows matching and/or frequency scanning compensation to be easily provided.

INDUSTRIAL APPLICABILITY

Although the antenna of the present invention may find wide application where variation of antenna parameters is required it is seen that the invention will find particular application in mobile communication applications including land, sea and air-borne terminals, satellite communications, and/or in situations where interference sources need to be suppressed by manipulation of the shape of the antenna to vary the radiation pattern of the antenna.

We claim:

1. A helix antenna comprising a conductor secured to a dielectric sheet, the dielectric sheet being furled so that the conductor is of generally helical form, said dielectric sheet being furlable and unfurlable to alter the characteristics of the antenna; wherein the dielectric sheet is rotationally furled or unfurled by rotating an outer side of the dielectric sheet relative to an inner side, and wherein the inner side of the dielectric sheet being secured to a central tube and the outer side of the dielectric sheet being secured to a radome surrounding the antenna, and wherein said dielectric sheet is furled and unfurled by relative rotation of the radome with respect to the central tube.

2. An antenna as claimed in claim 1 wherein the radome is rotated relative to the central tube by a drive means, said drive means being controlled by a control means which drives said drive means in response to signal strength information received from a received signal strength indicator.

3. An antenna as claimed in claim 1 wherein the antenna consists of two or more interleaved dielectric sheets, each dielectric sheet having one or more conductor affixed thereto.

4. An antenna as claimed in claim 1 wherein baluns or matching is provided by conductive elements secured to the dielectric sheet.

5. An antenna as claimed in claim 1 wherein load elements electrically connected to the conductor are provided at one or more positions along the dielectric sheet to provide frequency scanning compensation.

6. An antenna as claimed in claim 5 wherein the load elements consist of an inductive substantially U-shaped conductive element electrically connected between two ends of a conductor and a capacitive element consisting of a conductive strip between the two ends of the conductor separated therefrom by a dielectric material.

7. An antenna as claimed in claim 5 wherein the load elements consist of three stacked strips of conductive material separated by dielectric material, the strips being electrically connected at one end to one end of a conductor, with only the middle strip being connected to the end of the other conductor.

8. An antenna as claimed in claim 1 wherein matching is provided at the top of the central tube.

9. An antenna as claimed in claim 8 wherein one conductor of the antenna is feed via the central tube and the other conductor is feed via a rod passing through the central tube, wherein matching is provided by a quarter wave length rod of reduced diameter connected to the rod at the top of the central tube.

10. An antenna as claimed in claim 9 wherein a balun in the form of a quarter wavelength tube is provided about the top end of the central tube, and electrically connected thereto by a conductive sleeve between the base of the balun and the central tube.

* * * * *